United States Patent [19]

Tijs

[11] Patent Number: 4,630,529

[45] Date of Patent: Dec. 23, 1986

[54] PNEUMATICALLY OPERATING DEVICE COMPRISING MEANS FOR LIMITING THE DISPLACEMENT OF A PISTON

[75] Inventor: Hendricus C. P. Tijs, Mierlo, Netherlands

[73] Assignee: Weld-Equip b.v., Helmond, Netherlands

[21] Appl. No.: 676,284

[22] Filed: Nov. 29, 1984

[30] Foreign Application Priority Data

Dec. 5, 1983 [NL] Netherlands ..... 8304168

[51] Int. Cl.[4] ..... F15B 15/24

[52] U.S. Cl. ..... 92/13

[58] Field of Search ..... 92/13, 13.4, 13.41, 92/13.1, 13.5, 13.51, 13.8

[56] References Cited

U.S. PATENT DOCUMENTS

| | | | |
|---|---|---|---|
| 1,922,874 | 8/1933 | Tymstra | 92/13.8 X |
| 2,358,826 | 9/1944 | Purat | 92/13.1 X |
| 2,624,659 | 1/1953 | Haug et al. | 92/13 |
| 2,736,294 | 2/1956 | Buehner | 92/13.8 |
| 3,430,538 | 3/1969 | Weiss | 92/13.5 X |
| 4,091,969 | 5/1978 | Easter et al. | 92/13.4 |

FOREIGN PATENT DOCUMENTS

| | | | |
|---|---|---|---|
| 2655563 | 6/1978 | Fed. Rep. of Germany | 92/13 |
| 792722 | 4/1958 | United Kingdom | 92/13 |
| 823600 | 11/1959 | United Kingdom | 92/13 |

*Primary Examiner*—Robert E. Garrett
*Assistant Examiner*—Mark A. Williamson
*Attorney, Agent, or Firm*—Cushman, Darby & Cushman

[57] ABSTRACT

A pneumatically operating device comprising a cylinder in which a piston can reciprocate by varying the pressure on at least one side of the piston, which piston is connected on the working side with a projecting pin passed (in gastight manner) through the working end of the cylinder, while on the side opposite the working side the piston is connected with a projecting pin passed (in gastight manner) through an end of the cylinder opposite the working end, the projecting end extending by a given length through a hole of a setting ring and having, on the side of this ring remote from the cylinder, a stop exceeding the dimensions of the hole in said setting ring, the setting ring being displaceable in the direction of length of the cylinder.

7 Claims, 1 Drawing Figure

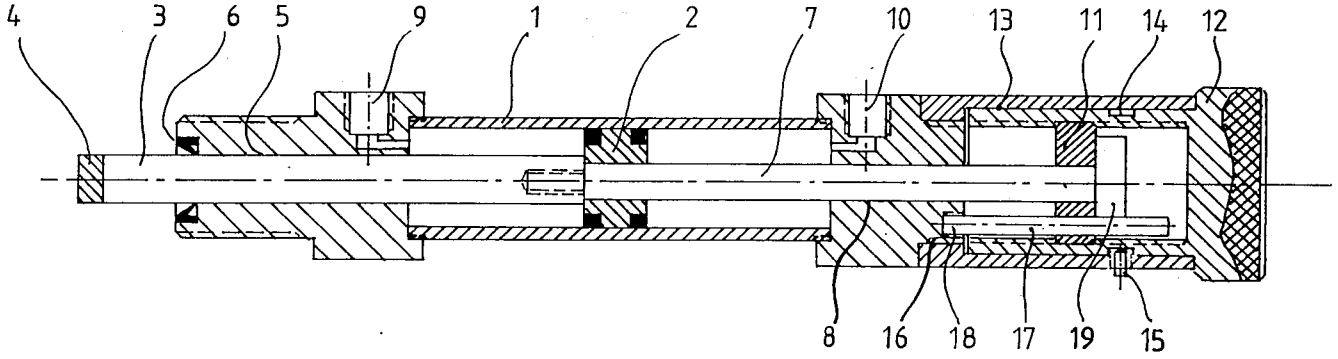
12
14
11
13
10
7
2
1
9
5
6
3
4
15
19
17
18
16
8

PNEUMATICALLY OPERATING DEVICE COMPRISING MEANS FOR LIMITING THE DISPLACEMENT OF A PISTON

The invention relates to a pneumatically operating device comprising a cylinder in which a piston can reciprocate by varying the pressure on at least one side of the piston.

Devices of the kind set forth are known and are frequently used in all kinds of apparatus and machines, in which part of the apparatus or the machine can be reciprocated. To this end said part is connected with the piston in a pneumatically operating cylinder by means of a pin. This applies in particular to the setting of the electrodes of an 'automatically operating' welding or soldering machine. In such a machine, for example a machine for making spot welds at least one of the electrodes is pressed against the parts to be welded. For passing an electric welding current through the welding electrode and the parts to be connected and a counter-electrode, which may also be formed by the material itself to be welded, it is desirable to control with particular accuracy the duration of the welding current and the pressure of the electrode. If this is not done, this will result in a burnt weld, a brittle weld or in no welding joint at all. Similar problems may also occur in automatic soldering machines. Although this problem has been recognized for a long time, no satisfying solution has yet been found to obtain an accurate setting of the stroke of the electrode and hence of the pressure of the electrode. This problem is even more conclusive if different materials have to be joined, for example thin plates and thick plates. In general a solution has been accepted in which the pressure in the pneumatic cylinder is controlled as accurately as possible and the time of the welding current is accurately controlled. The essential problem is that the pin connected with the piston and the pneumatic cylinder should find an accurately adjustable limit during the forward movement. The rearward movement is, of course, less critical. It is chosen to be not too long because in that case the working time of the apparatus would be unnecessarily prolonged. The limitation of the piston movement in rearward direction is a problem that can be simply solved, for example, by means of a set screw in a cover of a pneumatic cylinder. Much more difficult is the problem to ensure the forward limitation of a piston and the pin connected herewith, particularly if it is required for the setting to be controllable during the operation of the cylinder. Therefore, a self-explanatory solution of screwing a nut onto a pin projecting on the rear side is not suitable for the above-mentioned purpose. Such a nut can, of course, be set when the cylinder is out of operation, but during operation this is practically not possible. A further solution by using, for example, filling plates or filling rings is very cumbersome and cannot be changed during operation. The object of the invention is to avoid the above-mentioned problems by means of a specific construction of the device.

A pneumatically operating device embodying the invention comprises a cylinder in which a piston can reciprocate by varying the pressure on at least one side of the piston, which is connected on the working side with a projecting pin passed (in gastight manner) through the working end of the cylinder and is characterized in that on the side opposite the working side the piston is connected with a projecting pin passed (in gastight manner) through the end of the cylinder opposite the working end, the projecting end extending over a given length through a hole of a setting ring and having, on the side of this ring remote from the cylinder, a stop larger than the hole in the setting ring, said setting ring being displaceable in the direction of length of the cylinder.

Since the setting ring is displaceable in the direction of length of the cylinder and the stop cannot pass through the opening in the setting ring, a sharp limitation of the piston displacement and hence of the displacement of the projecting pin connected, for example, with a welding electrode is obtained in the forward direction. Such a limitation of the stroke in the forward direction, also termed working direction, has been found not to be known so far.

The stop on the pin co-operating with the setting ring may have various shapes. In very simple devices, for example, it is conceivable to use a split pin or a combination of a split pin and a rivet insertion between the split pin and the setting ring. In a particular embodiment of the invention the stop is preferably formed by a shoulder on the pin. This shoulder may be integral with the projecting part of the pin. Such a structure is capable of absorbing very heavy forces.

The pin provided with the stop, for example, the shoulder may be cylindrical but this is not necessary, since the pin need only slide through the opening in the setting ring and need not turn. The pin may have a hexagonal section.

A particularly simple and accurate, smoothly adjustable displacement of the setting ring can be obtained by a specific construction embodying the invention in which the setting ring is provided with external screwthread co-operating with the inner screwthread of a sleeve, which is rotatable in a sleeve-like prolongation of the cylinder, the setting ring being guarded against rotation and the sleeve being guarded against displacement. By turning the sleeve in the sleeve-like prolongation of the cylinder the setting ring is displaced because it is not rotatable in forward or rearward direction.

The setting ring is guarded preferably by means of a pin rigidly connected with the cylinder and freely passing through a hole in the setting ring. When the stop on the pin is a shoulder the guard pin preferably extends through a recess in the edge of the shoulder.

The sleeve-like prolongation of the cylinder, in which the internally screwthreaded sleeve is turning, is preferably fastened by screws at the end of the pneumatic cylinder. With this design all parts of the setting device can be manufactured in a simple manner. A further advantage is that such a setting device comprising a cylindrical sleeve, an internally screwthreaded sleeve, a setting ring and a guard pin can be fastened to an existing pneumatic device provided it has a cylinder having a continuous pin.

The internally screwthreaded sleeve can be guarded in known manner by making a groove in the outer wall of said sleeve and by screwing a bolt into the sleeve-like prolongation of the cylinder, which bolt fits in the groove. As an alternative, a spring clip may be used.

Where reference is made herein to a pneumatically operating device, this is to be understood to mean a device in which a gas pressure produces the displacement of a piston. The gas may be air, nitrogen or a different, appropriate gas. As the case may be, oil pressure could be used. The essential part of a device embodying the invention, that is to say, the part by which the setting is achieved need not be varied.

The invention will be described with reference to a drawing showing a longitudinal sectional view of one embodiment of the invention.

Referring to the FIGURE, reference numeral 1 designates the wall of a working cylinder in which a piston 2 can reciprocate. On the working side, that is to say, the left-hand side this piston is connected with a pin 3, which provides on the left-hand side the desired setting of, for example, a welding electrode. Reference numeral 4 designates an intermediate piece of nylon. The pin 3 moves to and fro through an opening 5 in the left-hand part of the cylinder and is passed in a gastight manner by means of a seal 6. On the right-hand side of the piston there is also provided a pin 7. As is indicated in the drawing the pin 3 is fastened to the pin 7 with the aid of screwthread. On the right-hand side the pin 7 passes in a gastight manner through an opening 8 in the right-hand end of the cylinder. Reference numerals 9 and 10 designate the inlet and outlet openings respectively for the gas.

On the right-hand side the drawing shows the setting device embodying the invention. The setting device comprises a setting ring 11 having external screwthread. This screwthread co-operates with internal screwthread of a sleeve 12. The sleeve 12 can turn in the sleeve-like prolongation 13 of the cylinder. The sleeve 12 is guarded against displacement by means of a groove 14 receiving a bolt 15. The sleeve 13 is screwed at 16 onto the pneumatic cylinder proper. Reference numeral 17 designates a guard pin, which is screwed at 18 into the end of the cylinder and which passes freely through an opening in the setting ring 11. When the sleeve 12 is turned, this guard pin prevents the setting ring from turning at the same time. Thus only a longitudinal displacement of the ring 11 occurs. Since the end of the pin 7 is provided with a shoulder 19, whose dimensions are larger than the opening in the setting ring 11, the piston with the pins connected herewith cannot slide further to the left than up to the instant at which the shoulder 19 strikes the setting ring 11. In this way an accurate setting of the stroke is ensured, which setting can be adjusted by turning the sleeve 12 both during a standstill and during the operation of the pneumatic cylinder The guard pin 17 passes through a small recess in the edge of the shoulder 19.

If desired a limitation of the stroke of the piston and the pins connected herewith to the right can be obtained by screwing a steel bolt into the end of the sleeve 12. Also this steel bolt can be turned during operation. As will be apparent from the drawing the entire construction in accordance with the invention is very elegant, in particular because substantially all parts are coaxial with the pneumatic cylinder.

It will be obvious to those skilled in the art that the means for limiting the displacement may as well be used in a purely mechanically operating device or in a hydraulically operating device. In this case there may be provided springs or other elastic members in order to avoid a breakdown.

I claim:

1. A fluid operated piston having an adjustable stroke including a cylinder having first and second end walls, the piston having first and second end faces and being reciprocatingly situated in the cylinder, the first face of the piston and the first end wall of the cylinder defining a work space, a first reciprocating pin fixed to and extending axially from the first face of the piston and extending through the work space and the first end wall, a second reciprocating pin fixed to and extending axially from the second face of the piston and through the second end wall, a cylindrical sleeve member having internal threads, the sleeve extending axially from the second end wall of the cylinder, a first stop member comprising an annular setting ring having a side facing the cylinder and a side facing away from the cylinder and threads on its periphery and threadedly received within the cylindrical sleeve member, a means to prevent rotation of the setting ring, the second pin slidably extending through the setting ring and having a second stop member capable of abutting the first stop member on the side thereof facing away from the cylinder, the cylindrical sleeve being rotatably mounted such that rotation of the sleeve causes axial displacement of the setting ring thereby adjusting the stroke of said piston.

2. A pneumatically operating device comprising a cylinder having two opposite end walls, in which cylinder a piston can reciprocate by varying the pressure in the cylinder on at least one side of the piston, said piston having a working side, a first pin fixed to and extending from the piston in the axial direction of reciprocating movement of the piston and passing through the cylinder end wall facing the working side of the piston in a gastight manner characterized in a second pin fixed to and extending from the piston in the direction of movement of the piston and passing through the end wall of the cylinder opposite the end wall facing the working side of the piston in a gastight manner, said second pin slidably extending through a hole in a setting ring and having, on the side of the setting ring remote from the cylinder, a stop member larger than the hole in the setting ring, and means for adjusting the position of the setting ring in the direction of movement of the piston in the cylinder, the setting ring having a screwthread on its periphery which cooperates with an internal screwthread provided in a first sleeve, which can turn in a second sleeve-like prolongation of the cylinder, and means for releasably preventing rotation of the setting ring and for releasably preventing axial displacement of the first sleeve.

3. A device as in claim 2 wherein the stop member is formed by a shoulder integral with the pin.

4. A welding device comprising a pneumatically operating device as in claim 2.

5. A device as in claim 2 wherein the second sleeve-like prolongation of the cylinder is screwed to the end of the cylinder.

6. A pneumatically operating device comprising a cylinder having two opposite end walls, in which cylinder a piston can reciprocate by varying the pressure in the cylinder on at least one side of the piston, said piston having a working side, a first pin fixed to and extending from the piston in the axial direction of reciprocating movement of the piston and passing through the cylinder end wall facing the working side of the piston in gastight manner characterized in a second pin fixed to and extending from the piston in the direction of movement of the piston and passing through the end wall of the cylinder opposite the end wall facing the working side of the piston in gastight manner, said second pin slidably extending through a hole in a setting ring and having, on the side of the setting ring remote from the cylinder, a stop member larger than the hole in the setting ring, and means for adjusting the position of the setting ring in the direction of movement of the piston in the cylinder, the setting ring being restrained against rotation by means of a pin rigidly secured to the cylinder and freely passing through a hole in the setting ring.

7. A pneumatically operating device comprising a cylinder having two opposite end walls, in which cylinder a piston can reciprocate by varying the pressure in the cylinder on at least one side of the piston, said piston having a working side, a first pin fixed to and extending from the piston in the axial direction of reciprocating movement of the piston and passing through the cylinder end wall facing the working side of the piston in gastight manner characterized in a second pin fixed to and extending from the piston in the direction of movement of the piston and passing through the end wall of the cylinder opposite the end wall facing the working side of the piston in gastight manner, said second pin slidably extending through a hole in a setting ring and having, on the side of the setting ring remote from the cylinder, a stop member in the form of a shoulder integral with said second pin and larger than the hole in the setting ring, a guard pin passing through a recess in the edge of the shoulder, and means for adjusting the position of the setting ring in the direction of movement of the piston in the cylinder.

* * * * *